US008181613B2

(12) United States Patent
Arinaga et al.

(10) Patent No.: US 8,181,613 B2
(45) Date of Patent: May 22, 2012

(54) VARIABLE VALVE SYSTEM FOR INTERNAL COMBUSTION ENGINE

(75) Inventors: Tsuyoshi Arinaga, Yamato (JP); Toru Fukami, Machida (JP); Shinichi Takemura, Yokohama (JP); Shunichi Aoyama, Yokosuka (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 452 days.

(21) Appl. No.: 12/474,780

(22) Filed: May 29, 2009

(65) Prior Publication Data

US 2009/0301418 A1 Dec. 10, 2009

(30) Foreign Application Priority Data

Jun. 4, 2008 (JP) ..... 2008-146538

(51) Int. Cl.
*F01L 1/34* (2006.01)

(52) U.S. Cl. ..... 123/90.16; 123/90.15; 123/90.39

(58) Field of Classification Search ..... 123/90.16, 123/90.15, 90.39; 74/559, 569
See application file for complete search history.

(56) References Cited

U.S. PATENT DOCUMENTS

| | | | |
|---|---|---|---|
| 6,029,618 | A | 2/2000 | Hara et al. |
| 6,382,150 | B1 | 5/2002 | Fischer |
| 2003/0131813 | A1 | 7/2003 | Moteki et al. |
| 2005/0028769 | A1 | 2/2005 | Todo et al. |
| 2005/0178350 | A1 | 8/2005 | Nakamura et al. |
| 2006/0112917 | A1 | 6/2006 | Nakamura et al. |
| 2009/0050086 | A1 | 2/2009 | Takemura et al. |

FOREIGN PATENT DOCUMENTS

| | | |
|---|---|---|
| JP | 2004-293406 | 10/2004 |
| WO | WO 2006/054147 A1 | 5/2006 |

*Primary Examiner* — Zelalem Eshete
(74) *Attorney, Agent, or Firm* — Drinker Biddle & Reath LLP

(57) ABSTRACT

A variable valve system for an internal combustion engine includes a drive shaft, a drive cam provided on the drive shaft, a link arm fitted on the outer periphery of the drive cam such as to rotate relative to the drive cam, a crank-shaped control shaft including a main shaft and an eccentric cam, an oscillating arm rotatably attached to the eccentric cam and oscillated by the link arm, and an oscillating cam connected to the oscillating arm via a link rod so as to actuate a valve. Lubricant is communicated from a main lubricant flow path in the drive shaft through three lubricant paths to sliding contact areas between the drive cam and the link arm, between the pin of the oscillating arm and the link arm, and between the eccentric cam and the oscillating arm.

12 Claims, 12 Drawing Sheets

VARIABLE VALVE SYSTEM FOR INTERNAL COMBUSTION ENGINE

CROSS-REFERENCE TO RELATED APPLICATIONS

This application claims priority to Japanese Patent Application No. 2008-146538 filed Jun. 4, 2008, which is incorporated by reference herein in its entirety.

BACKGROUND OF THE INVENTION

1. Field of the Invention

The present invention relates to providing lubrication to a variable valve system for an internal combustion engine.

2. Description of the Related Art

A valve operating mechanism known in the art includes a pair of intake valves, a drive shaft extending in the front-to-rear direction of an engine, a camshaft provided for each cylinder and rotatably and coaxially supported on an outer peripheral surface of the drive shaft, a drive cam provided at a predetermined position along the drive shaft, a pair of oscillating cams for opening the intake valves, a transmission mechanism connected between the drive cam and one of the oscillating cams so as to transmit rotation force of the drive cam as oscillating force (valve opening force) of the oscillating cam, and a control mechanism for changing the operating position of the transmission mechanism.

The transmission mechanism includes a rocker arm provided above the drive shaft, a link arm linking one end of the rocker arm and the drive cam, and a link rod linking the other end of the rocker arm and a cam-nose portion of one of the oscillating cams. The control mechanism includes a control shaft rotatably supported by a bearing provided above the drive shaft, and a control cam fixed to the outer periphery of the control shaft and serving as a fulcrum of the oscillating motion of the rocker arm.

The rocker arm has a support hole that rotatably supports the control cam. The link arm has a fitting hole rotatably connected to an outer peripheral surface of the drive cam, and a pin hole to which a pin projecting from the rocker arm is connected.

Lubricant is supplied from a lubricant flow path provided in the drive shaft into the space between the outer peripheral surface of the drive cam and an inner surface of the fitting hole of the link arm, and into the space between the pin of the rocker arm and the pin hole of the link arm. Lubricant is also supplied from a lubricant flow path, which extends in the axial direction in the control shaft, into the space between the support hole of the rocker arm and the control cam.

SUMMARY OF THE INVENTION

According to the present invention, lubricant can be supplied to the sliding contact area between the eccentric cam of the control shaft and the oscillating arm without forming a lubricant flow path in the crank-shaped control shaft. For this reason, it is possible to prevent the strength of a connecting portion between the main shaft and the eccentric cam in the control shaft from being significantly reduced as compared with a case in which the lubricant flow path is provided in the crank-shaped control shaft. Moreover, it is possible to supply lubricant into the sliding contact area between the eccentric cam of the control shaft and the oscillating arm without increasing the weight of the control shaft.

In an embodiment of the present invention, a variable valve system is provided for an internal combustion engine. The system includes a drive shaft configured to rotate in synchronization with rotation of the engine, a drive cam disposed about an outer periphery of the drive shaft, a link arm having a first end and a second end, a control shaft extending parallel to the drive shaft and including a main shaft and an eccentric cam, wherein an axis of the main shaft is spaced apart from an axis of the eccentric cam, and an oscillating arm having a control shaft support portion rotatably connected to the eccentric cam of the control shaft. The first end of the link arm is connected to an outer periphery of the drive cam to rotate relative to the drive cam, and the second end of the link arm is connected via a pin to the oscillating arm, the oscillating arm being configured and arranged to be oscillated by the link arm. The system further includes a link rod having a first end and a second end, the first end rotatably connected to the oscillating arm, and an oscillating cam rotatably supported by the drive shaft and connected to the second end of link rod, the oscillating cam being configured and arranged to actuate a valve of the engine. A main lubricant flow path is provided in the drive shaft. A first lubricant flow path is formed in the drive shaft and the drive cam, the first lubricant path being configured to cause the main lubricant flow path to communicate lubricant to a first sliding contact area between the drive cam and the first end of the link arm. A second lubricant flow path is formed in the link arm and configured to cause the first sliding contact area to communicate lubricant to a second sliding contact area between the pin of the oscillating arm and the second end of the link arm. A third lubricant flow path formed in the oscillating arm and configured to cause the second sliding contact area to communicate lubricant to a third sliding contact area between the eccentric cam of the control shaft and the control shaft support portion of the oscillating arm.

In another embodiment of the invention, a method is provided for lubricating a variable valve system for an internal combustion engine. The variable valve system includes a drive shaft configured to rotate in synchronization with rotation of the engine, a drive cam disposed about an outer periphery of the drive shaft, a link arm having a first end connected to an outer periphery of the drive cam to rotate relative to the drive cam, a control shaft extending parallel to the drive shaft and including a main shaft and an eccentric cam, wherein an axis of the main shaft is spaced apart from an axis of the eccentric cam, an oscillating arm having a control shaft support portion rotatably connected to the eccentric cam of the control shaft, the oscillating arm having a pin connected to a second end of the link arm, the oscillating arm being configured and arranged to be oscillated by the link arm to transfer a drive force of the drive cam, a link rod having a first end rotatably connected to the oscillating arm, an oscillating cam rotatably supported by the drive shaft and connected to a second end of link rod, the oscillating cam being configured and arranged to actuate a valve of the engine. The method includes flowing lubricant through a main lubricant flow path in the drive shaft, flowing lubricant through a first lubricant flow path in the drive shaft and the drive cam thereby causing the main lubricant flow path to communicate lubricant to a first sliding contact area between the drive cam and the first end of the link arm, flowing lubricant through a second lubricant flow path in the link arm thereby causing the first sliding contact area to communicate lubricant to a second sliding contact area between the pin of the oscillating arm and the second end of the link arm, and flowing lubricant through a third lubricant flow path in the oscillating arm thereby causing the second sliding contact area to communicate lubricant to a third sliding contact area between the eccentric cam of the control shaft and the control shaft support portion of the oscillating arm.

In another embodiment of the invention, a variable valve system is provided for an internal combustion engine. The system includes a drive shaft configured to rotate in synchronization with rotation of the engine, a drive cam disposed about an outer periphery of the drive shaft, a link arm having a first end and a second end, a control shaft extending parallel to the drive shaft and including a main shaft and an eccentric cam, wherein an axis of the main shaft is spaced apart from an axis of the eccentric cam, and an oscillating arm having a control shaft support portion rotatably connected to the eccentric cam of the control shaft. The first end of the link arm is connected to an outer periphery of the drive cam to rotate relative to the drive cam, and the second end of the link arm is connected to a pin connected of the oscillating arm, the oscillating arm being configured and arranged to be oscillated by the link arm. The system further includes a link rod having a first end and a second end, the first end rotatably connected to the oscillating arm, and an oscillating cam rotatably supported by the drive shaft and connected to the second end of link rod, the oscillating cam being configured and arranged to actuate a valve of the engine. A main lubricant flow path is provided in the drive shaft. The system further includes means for communicating lubricant from the main lubricant flow path to a first sliding contact area between the drive cam and the first end of the link arm, means for communicating lubricant from the first sliding contact area to a second sliding contact area between the pin of the oscillating arm and the second end of the link arm, and means for communicating lubricant from the second sliding contact area to a third sliding contact area between the eccentric cam of the control shaft and the control shaft support portion of the oscillating arm.

BRIEF DESCRIPTION OF THE DRAWINGS

The accompanying drawings, which are incorporated herein and constitute part of this specification, illustrate preferred embodiments of the invention, and together with the general description given above and the detailed description given below, serve to explain features of the invention.

DESCRIPTION OF THE PREFERRED EMBODIMENTS

An embodiment of the present invention will be described in detail below with reference to the attached drawings.

Figure 1:
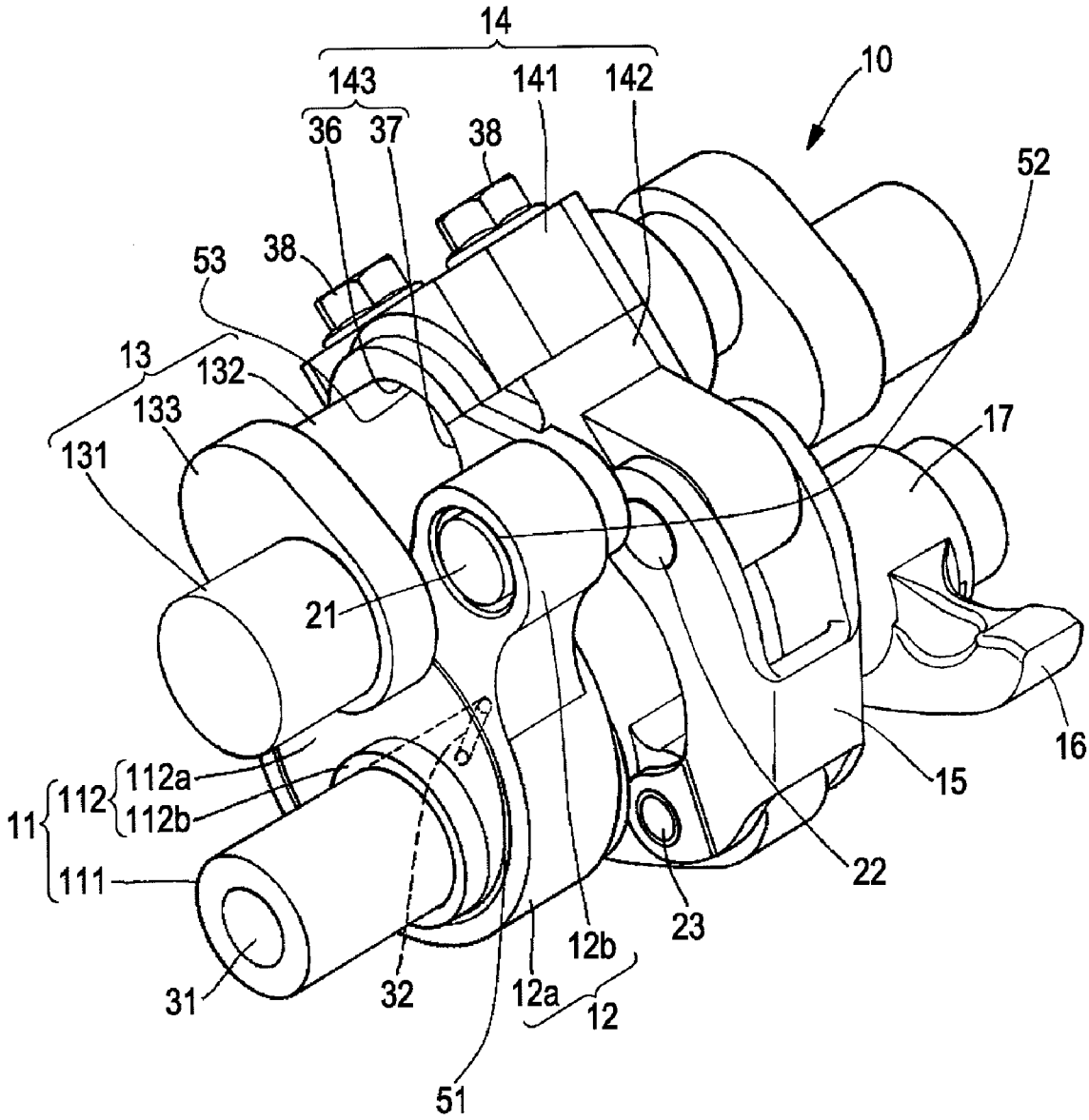
FIG. 1 is a schematic explanatory view of a variable valve system for an internal combustion engine according to an embodiment of the present invention.
Figure 2:
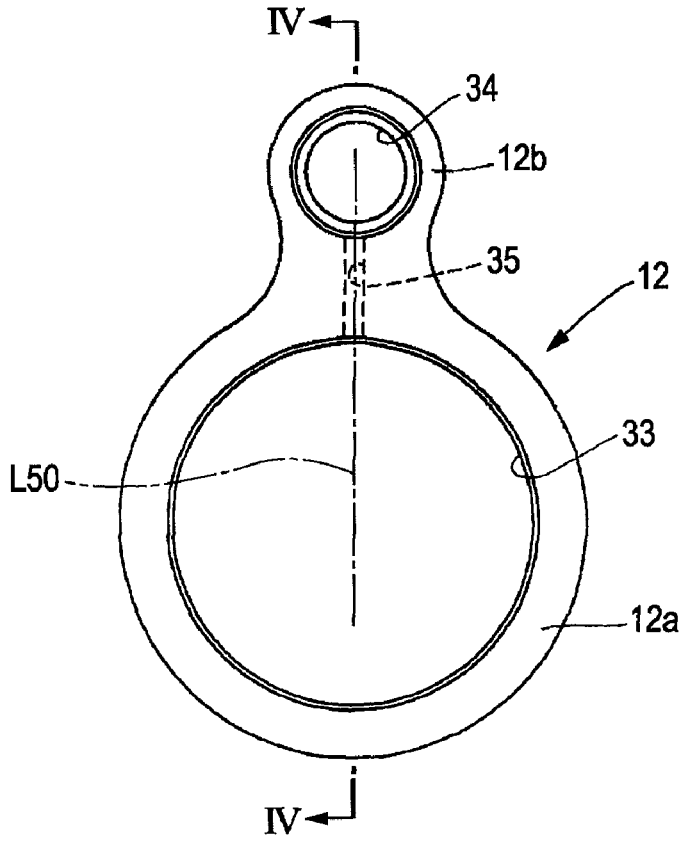
FIG. 2 is a front view of a link arm from the variable valve system of the embodiment.
Figure 3:
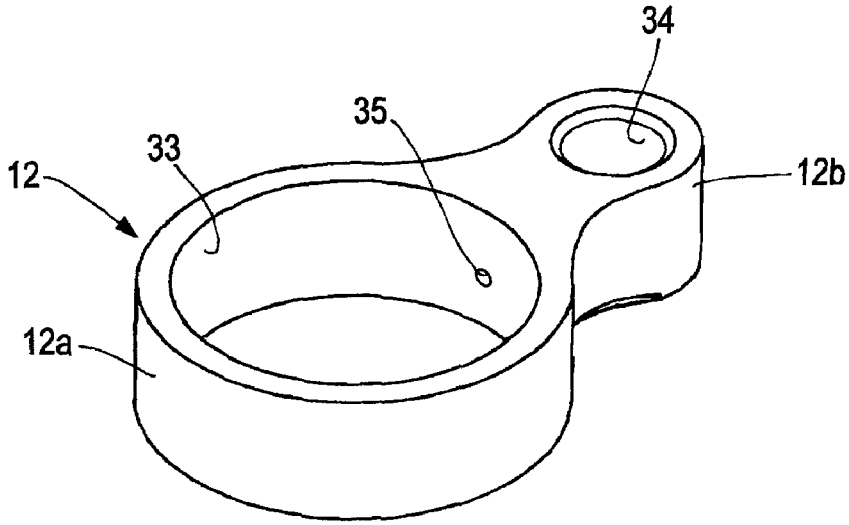
FIG. 3 is a perspective view of the link arm shown in FIG. 2.
Figure 4:
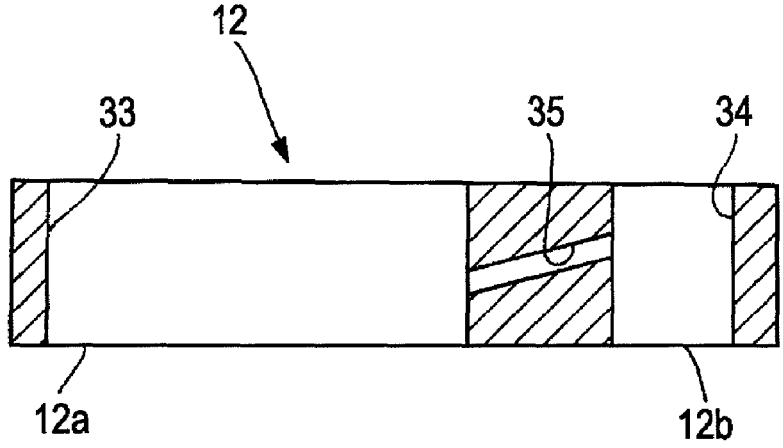
FIG. 4 is a cross-sectional view, taken along line IV-IV in FIG. 2.

FIG. 1 is a schematic explanatory view of a variable valve system 10 for an internal combustion engine according to the embodiment of the present invention. In the variable valve system 10 of the embodiment, two valves (e.g., intake valves), which are not shown, are provided for each cylinder. The valve lift of the valves can be changed in accordance with the operating state of the engine.

Specifically, in the variable valve system 10 of the embodiment, the valve lift and the angle range from an opening time to a closing timing of the valve (i.e., operating angle and the opening period) are variable to be smaller in a low-speed low-load region than in a high-speed high-load region, and variable to be larger in the high-speed high-load region than in the low-speed low-load region. In other words, the operating angle of the valve increases as the valve lift increases, and decreases as the valve lift decreases.

The variable valve system 10 includes a drive shaft 11, a drive cam 112, a link arm 12, a control shaft 13, an oscillating arm 14, and an oscillating cam 16. The drive shaft 11 is rotatably supported at an upper portion of a cylinder head, and extends in the engine front-to-rear direction (i.e., in a direction substantially parallel to the alignment of the cylinders). The drive cam 112 is provided on the drive shaft 11. The link arm 12 is fitted on the outer periphery of the drive cam 112 in a manner to rotate relative to the drive cam 112. The control shaft 13 is rotatably provided parallel to the drive shaft 11, and includes a main shaft 131, an eccentric cam 132, and a web plate 133. The oscillating arm 14 is rotatably attached to the eccentric cam 132 of the control shaft 13, and is oscillated by the link arm 12. The oscillating cam 16 is rotatably supported on the drive shaft 11, and is connected to the oscillating arm 14 via a long link rod 15. The oscillating cam 16 oscillates together with the oscillating arm 14 so as to actuate a valve (not shown).

In a transmission mechanism, as the amount of eccentricity of the control cam with respect to the control shaft increases, the outer diameter of the control cam gradually increases. This makes the layout of the components difficult. For example, when the control shaft is changed to a crank-shaped control shaft in which an eccentric cam is offset from a main shaft, as shown in FIG. 1, ease of layout of the components can be enhanced from a predetermined amount of eccentricity.

Unfortunately, in a case in which the control shaft is shaped like a crank, when the lubricant flow path for supplying lubricant into the space between the support hole of the rocker arm and the control cam extends in the axial direction through the control shaft, the ratio of the area of the lubricant flow path to the total area of a connecting portion between the main shaft and the eccentric cam on a cross section of the connecting portion perpendicular to the control shaft becomes relatively high. This may seriously decrease the strength of the connecting portion. The present invention overcomes this problem.

Further, in the crank-shaped control shaft, when the diameters of the main shaft and the eccentric cam are increased and the cross-sectional area of the connecting portion between the control shaft and the eccentric cam perpendicular to the control shaft is increased, the weight of the control shaft is increased. The present invention overcomes this problem.

In the variable valve system 10, the drive shaft 11 rotates in synchronization with the rotation of the engine, and the oscillating cam 16 oscillates in association with the drive shaft 11, thus opening and closing the valve. The drive shaft 11 and the control shaft 13 are rotatably supported by a bearing (not shown).

The drive shaft 11 is rotated by the torque transmitted from a crankshaft (not shown) of the engine, and includes a cylindrical drive shaft body 111 and the drive cam 112. A main lubricant flow path 31 is provided in the drive shaft body 111. The drive cam 112 is fixed to the drive shaft body 111, and co-rotates with the drive shaft body 111.

The drive cam 112 is an eccentric rotating cam whose axis is offset from the axis of the drive shaft body 111, and includes a cam body 112*a* and a boss 112*b*. The cam body 112*a* and the boss 112*b* are provided integrally.

The axis of the cam body 112*a* is offset by a predetermined amount in the radial direction from the axis of the drive shaft body 111. The drive cam 112 is connected and fixed to the drive shaft body 111. The drive shaft 11 is provided with a first lubricant flow path 32 that opens at one end (first end) into the main lubricant flow path 31 and opens at the other end (second end) into the outer peripheral surface of the drive cam 112.

The control shaft 13 is shaped like a crank such that the axis of the eccentric cam 132 is offset from the axis of the main shaft 131. In other words, in the control shaft 13, the axis of the eccentric cam 132 is spaced apart from the axis of the main shaft 131, and the main shaft 131 and the eccentric cam 132 are connected via the web plate 133, which is shaped like a thin plate. For example, the control shaft 13 is controlled by an electric motor or a hydraulically operated actuator (not shown) so as to rotate within a predetermined rotation angle range.

The actuator controls the rotation of the control shaft 13 on the basis of the current driving state of the engine detected from detection signals from various sensors such as, but not limited to, a crank-angle sensor, an air flow meter, and a water temperature sensor. When the rotation of the control shaft 13 is controlled, the offset position of the eccentric cam 132 is adjusted, and the oscillation center of the oscillating arm 14 is changed. In accordance with the rotation angle position of the control shaft 13, the valve lift and operating angle simultaneously and continuously increase or decrease. With the increase or decrease in the valve lift and operating angle, as the valve opening timing is advanced or retarded a predetermined time, the valve closing timing is similarly retarded or advanced.

Referring to FIGS. 1 to 4, the link arm 12 includes a large end portion 12*a* fitted on the outer periphery of the drive cam 112 so as to rotate relative to the drive cam 112, and a small end portion 12*b* fitted on the outer periphery of a pin 21 of the oscillating arm 14 so as to rotate relative to the pin 21. The link arm 12 is adjacent to the oscillating arm 14 in the control-shaft axial direction (axial direction of the control shaft 13).

The link arm 12 is provided with a second lubricant flow path 35 that linearly extends in a manner to be open at one end (first end) to an inner peripheral surface 33 of the large end portion 12*a* and to be open at the other end (second end) to an inner peripheral surface 34 of the small end portion 12*b*. The first end of the second lubricant flow path 35 is open on a small-end-portion side (on the upper side in FIG. 2) of a sliding contact area 51 between the drive cam 112 and the large end portion 12*a* (hereinafter referred to as a first sliding contact area 51), and the second end of the second lubricant flow path 35 is open on a large-end-portion side (on the lower side in FIG. 2) of a sliding contact area 52 between the pin 21 of the oscillating arm 14 and the small end portion 12*b* (hereinafter referred to as a second sliding contact area 52). The inner peripheral surface 33 of the large end portion 12*a* rotatably supports the outer peripheral surface of the drive cam 112, and the inner peripheral surface 34 of the small end portion 12*b* rotatably supports the outer peripheral surface of the pin 21. The axis of the second lubricant flow path 35 coincides with a straight line L50 connecting the center of the large end portion 12*a* and the center of the small end portion 12*b* when the link arm 12 is viewed from the front (see FIG. 2).

The second lubricant flow path 35 guides lubricant, which is supplied to the first sliding contact area 51 by the second end of the first lubricant flow path 32 opening in the outer peripheral surface of the drive cam 112, from the large end portion 12*a* (first sliding contact area 51) to the small end portion 12*b*, thus lubricating the second sliding contact area 52.

Referring to FIGS. 1 and 5 to 7, the oscillating arm 14 includes a cap 141, and an arm body 142 having a columnar pin 21 linked to the link arm 12. In the oscillating arm 14, the eccentric cam 132 is clamped and rotatably supported between the cap 141 and the arm body 142, which is closer to the drive shaft 11 than the cap 141.

In other words, the oscillating arm 14 includes a control-shaft support portion 143 for rotatably supporting the eccentric cam 132 of the control shaft 13, and the columnar pin 21 linked to the link arm 12. The control-shaft support portion 143 includes a cap-side control-shaft support portion 36 provided in the cap 141, and an arm-body-side control-shaft support portion 37 provided in the arm body 142. The oscillating arm 14 has the control-shaft support portion 143 at one end (first end) and the pin 21 at the other end (second end). The cap 141 and the arm body 142 are coupled by bolts 38.

Figure 5:
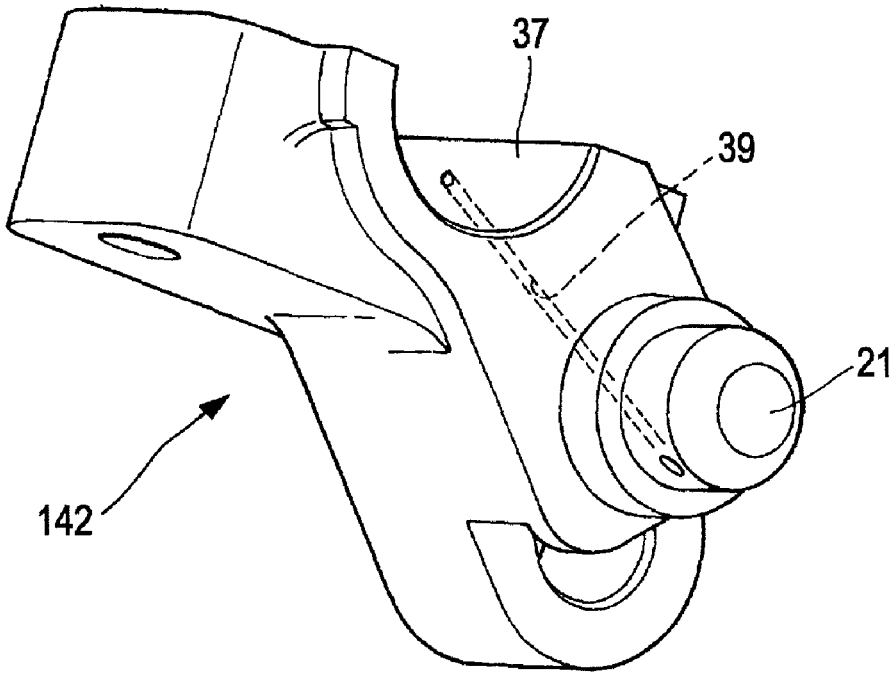
FIG. 5 is a perspective view of an arm body of an oscillating arm from the variable valve system of the embodiment.
Figure 6:
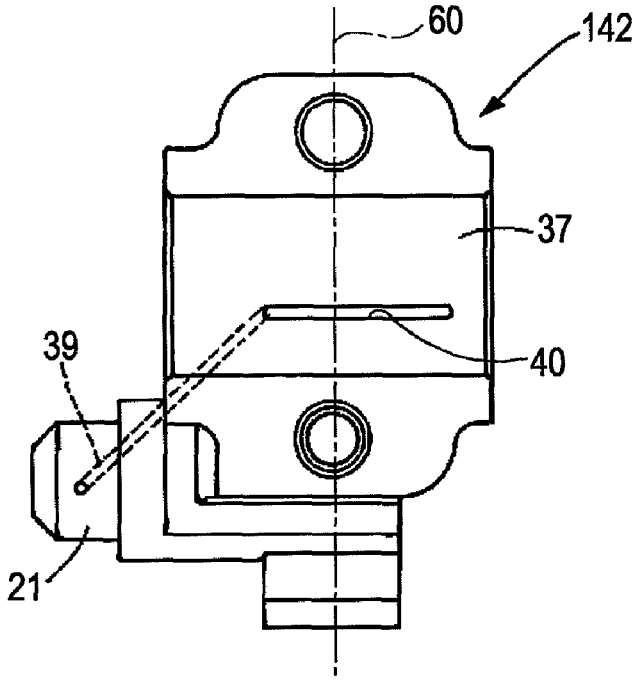
FIG. 6 is a plan view of the arm body of the oscillating arm shown in FIG. 5.

As shown in FIGS. 5 and 6, the arm body 142 of the oscillating arm 14 is provided with a third lubricant flow path 39 linearly extending in a manner to open at one end (first end) in an outer peripheral surface of the pin 21 and open at the other end (second end) in the arm-body-side control-shaft support portion 37. That is, the first end of the third lubricant flow path 39 provided in the oscillating arm 14 opens into the second sliding contact area 52, and the second end thereof opens into a sliding contact area 53 between the eccentric cam 132 of the control shaft 13 and the control-shaft support portion 143 of the oscillating arm 14 (hereinafter referred to as a third sliding contact area 53).

The second end of the third lubricant flow path 39 is set to open at a position shifted from a center position 60 of the third sliding contact area 53 toward the link arm side (left side in FIG. 6) in the control-shaft axial direction.

Figure 7:
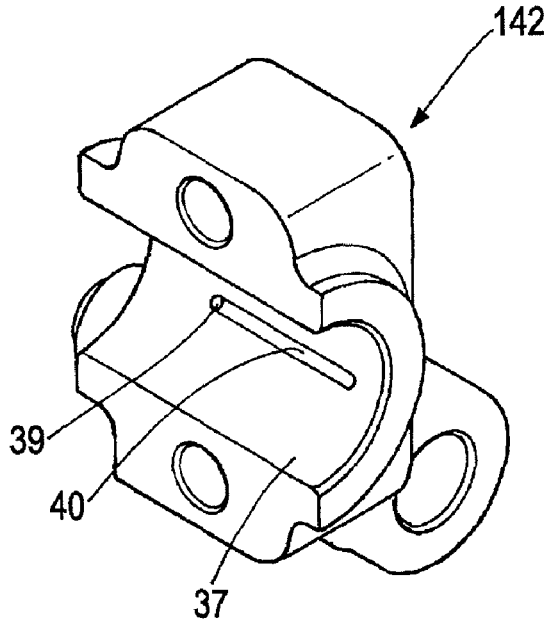
FIG. 7 is a perspective view of the arm body of the oscillating arm shown in FIG. 5.

A first lubricant groove 40 can be provided in the control-shaft support portion 143 of the oscillating arm 14, as shown in FIGS. 6 and 7. The first lubricant groove 40 extends in the axial direction of the control shaft 13 across the center position 60 in the control-shaft axial direction of the third sliding contact area 53 between the control-shaft support portion 143 and the eccentric cam 132 of the control shaft 13. Further, the first lubricant groove 40 is provided in the arm-body-side control-shaft support portion 37 of the arm body 142 so as to be connected to the second end of the third lubricant flow path 39.

With this structure, lubricant can be easily supplied to the link-rod side of the cap 141, and lubrication performance of the third sliding contact area between the eccentric cam 132 of the control shaft 13 and the control-shaft support portion 143 of the oscillating arm 14 can be improved. Further, since the first lubricant groove 40 is provided in the arm body 142, it is possible to easily guide the lubricant at low cost toward the link-rod side of the control-shaft support portion 143 of the oscillating arm 14 where the eccentric cam 132 of the control shaft 13 contacts and the link-rod side of the control-shaft support portion 143 receives comparatively large pressure force by the eccentric cam 132.

The link rod 15 is connected at one end (first end) to the arm body 142 of the oscillating arm 14 via a pin 22 (first connecting point of the link rod), and at the other end (second end) to the oscillating cam 16 via a pin 23 (second connecting point of the link rod) serving as a fulcrum. In other words, the link rod 15 is connected at the first end to the second end of the oscillating arm 14 via the pin 22. That is, the link rod 15 is linked to the oscillating arm 14 via the pin 22 that is provided on the same side of the control shaft 13 as that of the pin 21 of the oscillating arm 14. The distance from the pin 22 to the axis of the eccentric cam 132 is larger than the distance from the pin 21 to the axis of the eccentric cam 132.

The oscillating cam 16 is fixed to an annular member 17. The drive shaft 11 is placed to pass through the annular member 17. The annular member 17 freely turns around the drive shaft 11 and the oscillating cam 16 oscillates with the turning of the annular member 17. The valve is opened and closed by the oscillation of the oscillating cam 16.

In the variable valve system 10 of this embodiment, the pin 21 serves as the fulcrum of the oscillating arm 14 relative to the link arm 12 and the pin 22 serves as the fulcrum of the link rod 15 relative to the oscillating arm 14. The pins 21 and 22 are provided on the same side of the oscillating arm 14 with respect to the control shaft 13, that is, at the second end of the oscillating arm 14. Therefore, the oscillating arm 14 is pulled down by the drive cam 112 to lift the valve. In this case, a load in the pulling direction acts on the link arm 12.

The acting load will be described in detail below with reference to FIGS. 8 and 9.

Figure 8A:
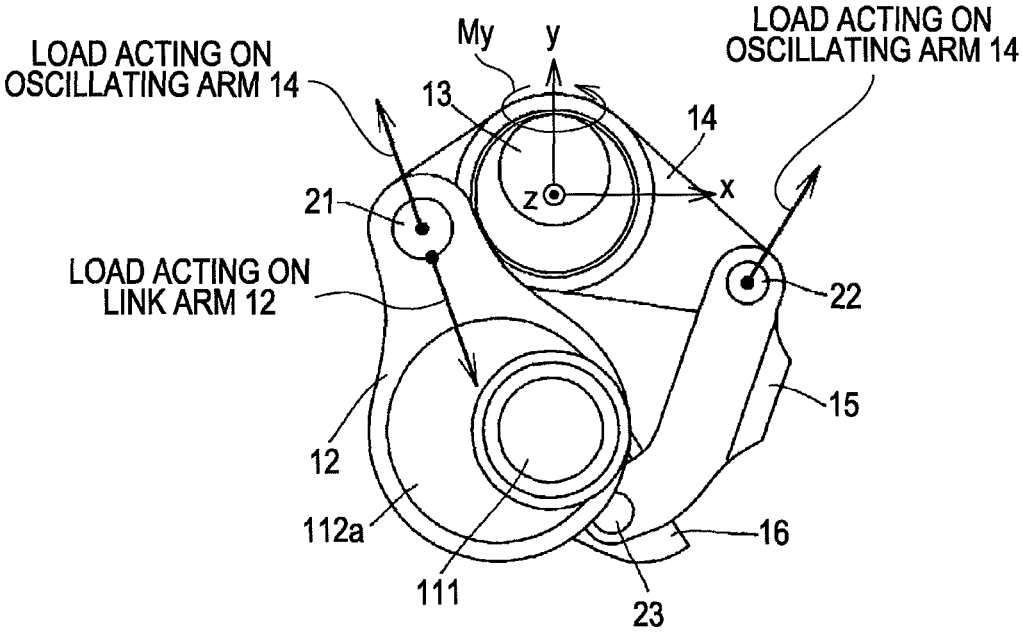
FIG. 8A is a side view showing a link state provided when a valve is opened in a variable valve system of a comparative example in which a link arm and a link rod are connected to an oscillating arm with a control shaft disposed therebetween.
Figure 8B:
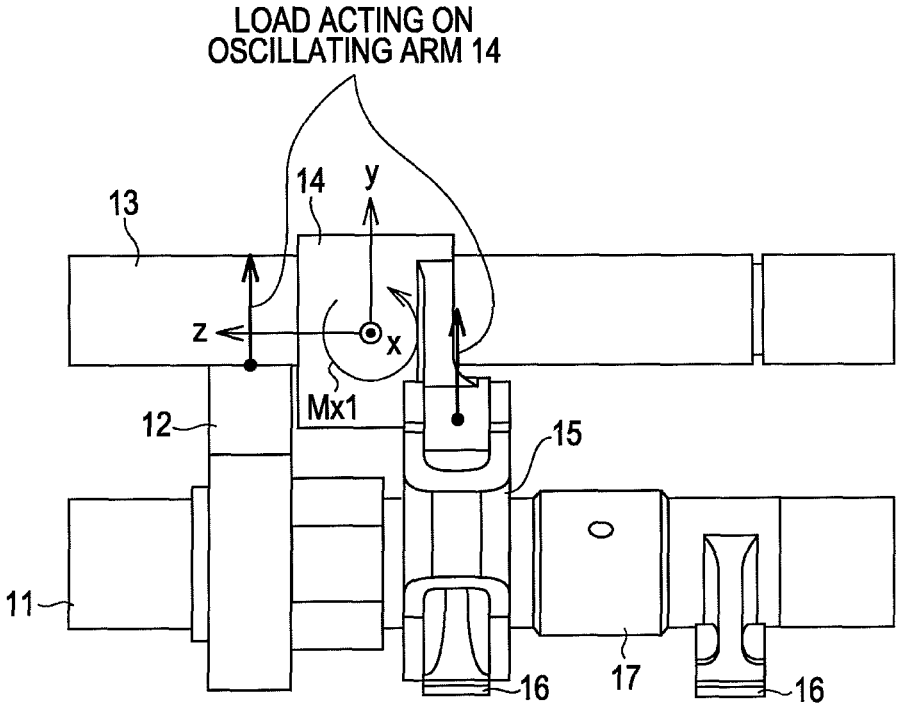
FIG. 8B is a front view of the variable valve system of the comparative example.
Figure 8C:
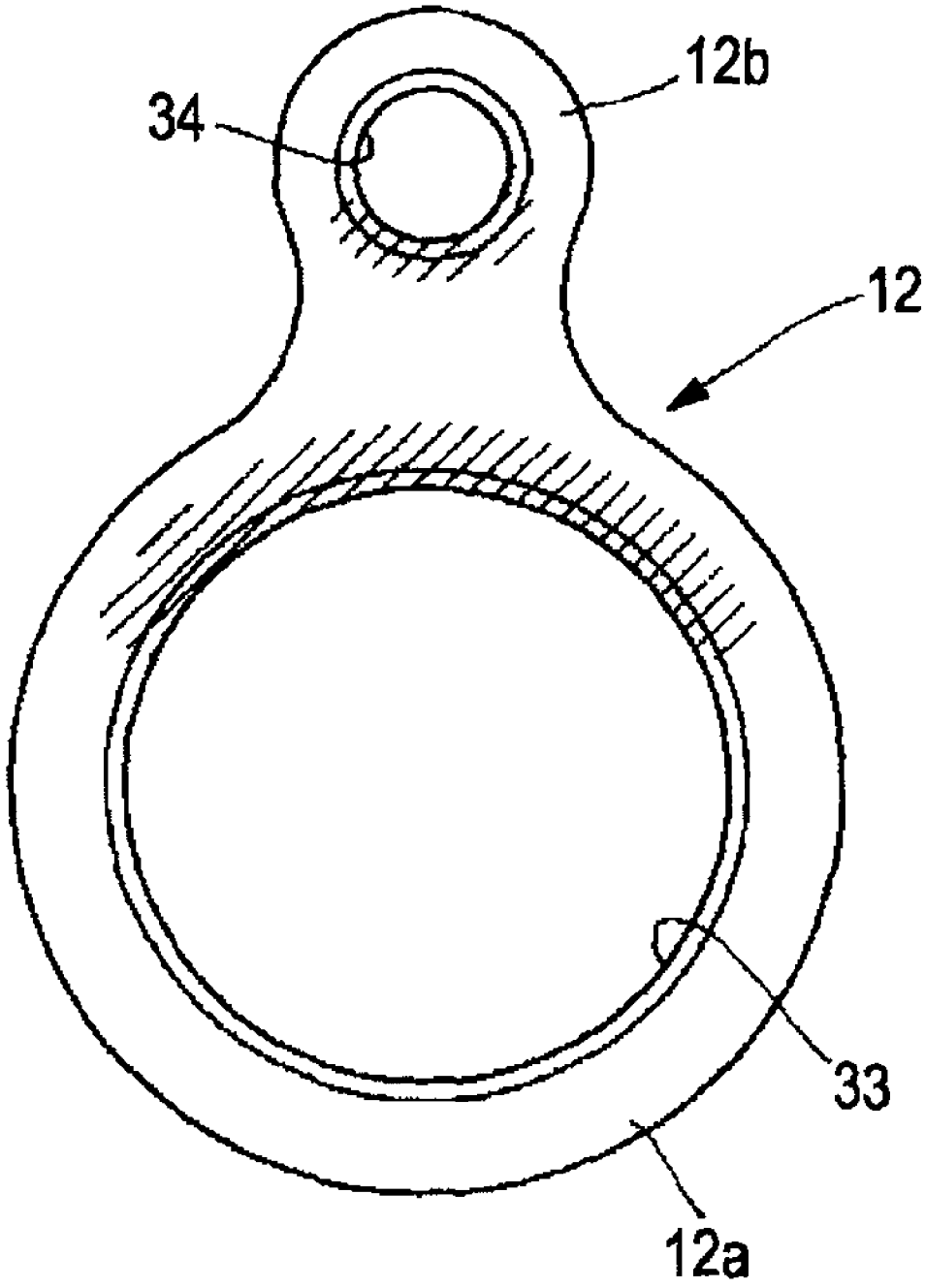
FIG. 8C is the link arm viewed in the axial direction of the control shaft in the variable valve system of the comparative example.

FIGS. 8A, 8B, and 8C show a comparative example of a variable valve system in which a pin 21 and a pin 22 are provided on opposite sides of a control shaft 13. FIGS. 8A and 8B are a side view and a front view, respectively, showing a link state when the valve is opened, and FIG. 8C is the link arm 12 viewed in the axial direction of the control shaft.

Figure 9A:
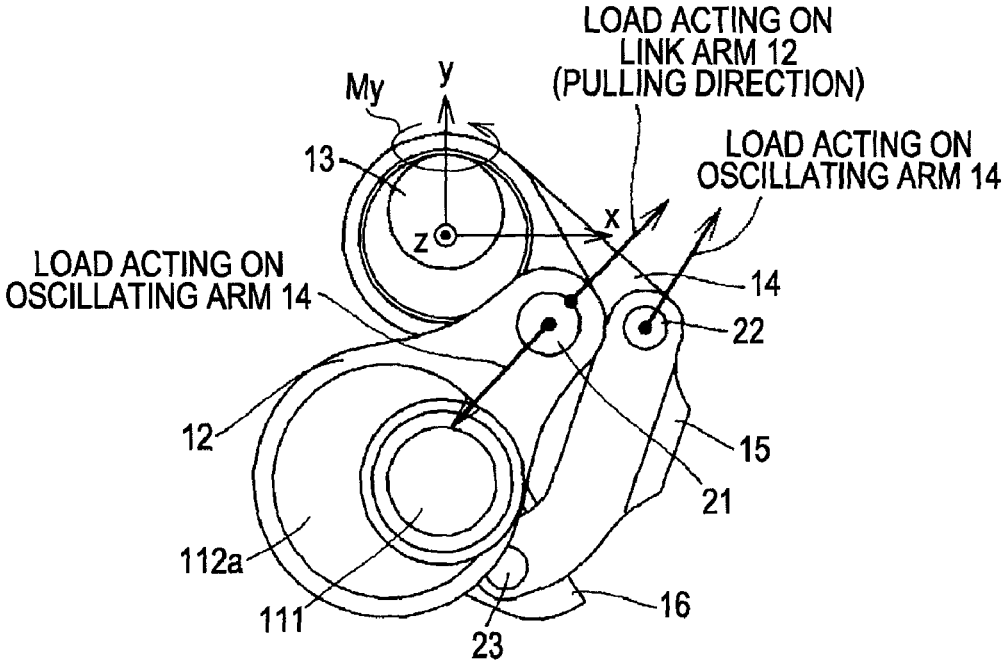
FIG. 9A is a side view showing a link state provided when a valve is opened in the variable valve system of the embodiment in which the link arm and a link rod are connected to the oscillating arm on the same side of a control shaft.
Figure 9B:
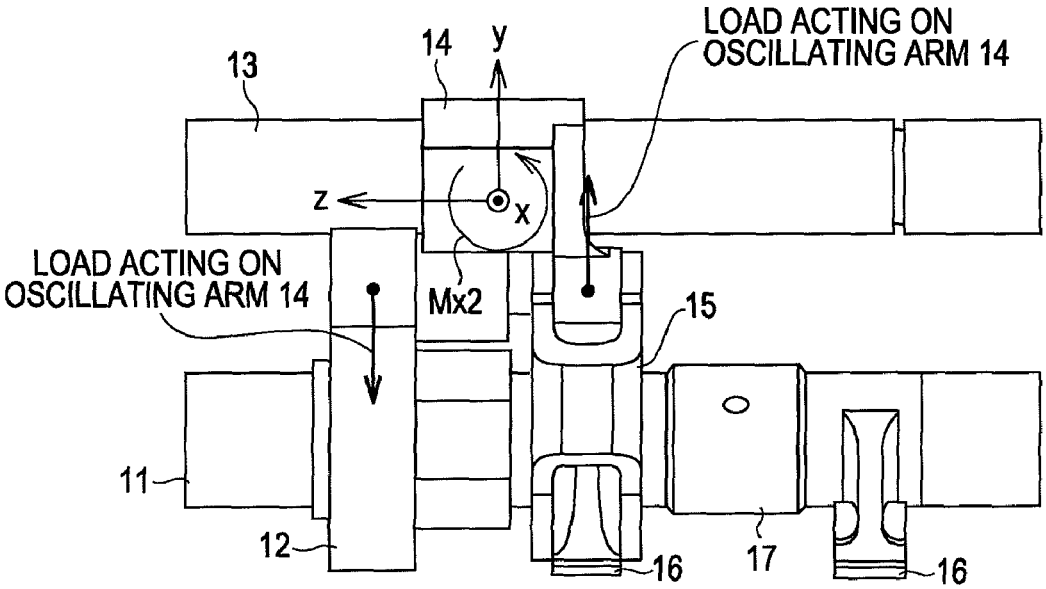
FIG. 9B is a front view of the variable valve system of the embodiment.
Figure 9C:
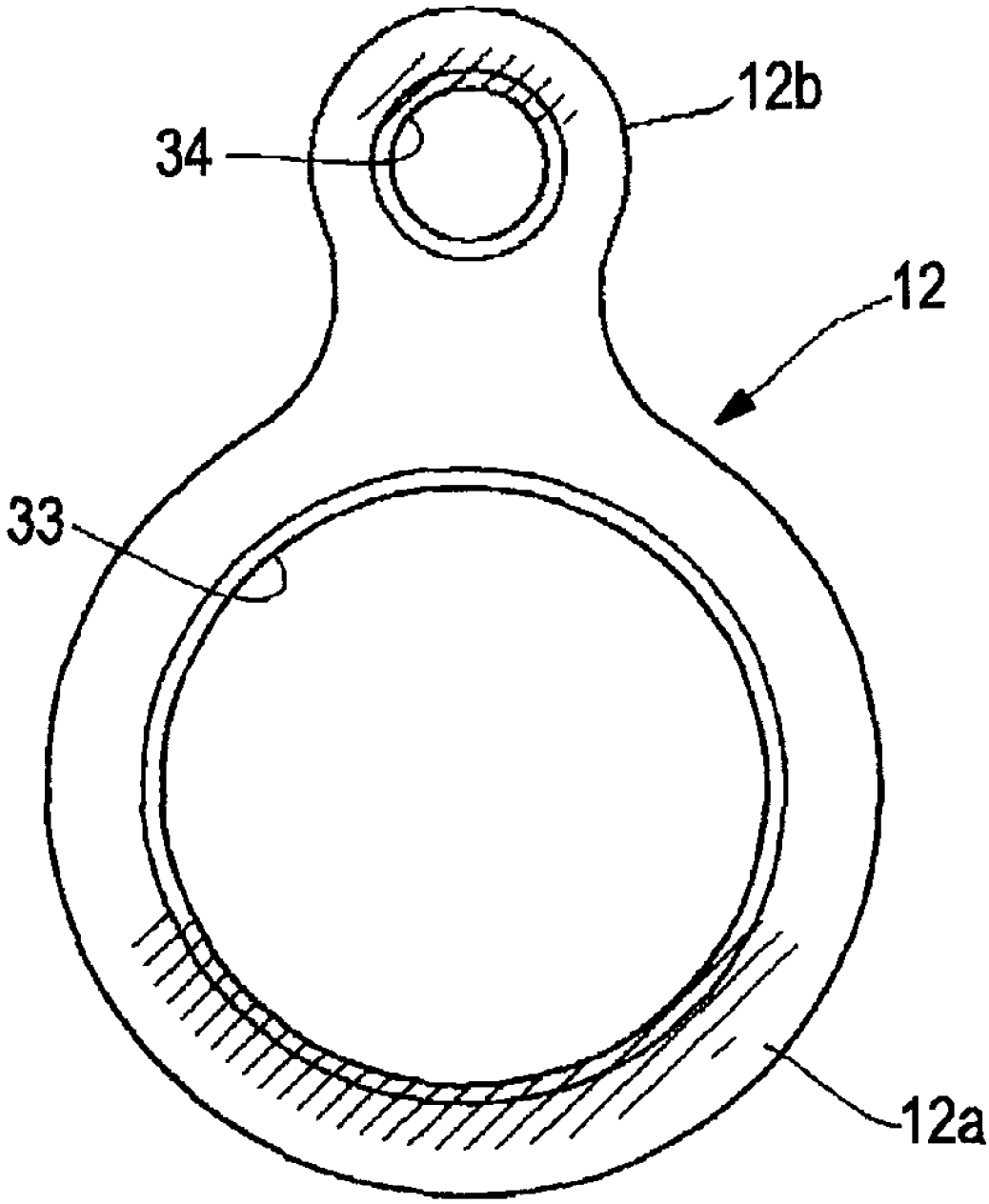
FIG. 9C is the link arm viewed in the axial direction of the control shaft in the variable valve system of the embodiment.

FIGS. 9A, 9B, and 9C show the variable valve system of the above-described embodiment, that is, a variable valve system in which the pin 21 and the pin 22 are provided on the same side of the control shaft 13. FIGS. 9A and 9B are a side view and a front view, respectively, showing a link state when the valve is opened, and FIG. 9C is the link arm 12 viewed in the axial direction of the control shaft.

In FIGS. 8A, 8B, and 8C, for convenience of explanation, the same components as those adopted in the embodiment are denoted by the same reference numerals, and redundant descriptions thereof are omitted.

In the variable valve system in which the pin 21 and the pin 22 are provided on opposite sides of the control shaft 13, as shown in FIGS. 8A and 8B, when the valve is opened, loads act as follows. That is, when the drive shaft 11 rotates and the cam body 112*a* moves up, the pin 21 is also moved up via the link arm 12. Then, the pin 22 is moved down via the oscillating arm 14.

Subsequently, the oscillating cam 16 is pushed down via the link rod 15, so that the valve is opened. When the valve is thus opened, a load acts on the link arm 12 in a compression direction, and an upward load acts on each end of the oscillating arm 14, as shown in FIG. 8A. For this reason, in the link arm 12, a contact load occurs on the lower side of the small end portion 12*b*, and a contact load occurs on the upper side of the large end portion 12*a*, as schematically shown by diagonal lines in FIG. 8C. Therefore, the small-end-portion inner peripheral surface 34 and the pin 21 of the oscillating arm 14 are not in uniform contact with each other in the circumferential direction of the small-end-portion inner peripheral surface 34. Further, the large-end-portion inner peripheral surface 33 and the drive cam 112 are not in uniform contact with each other in the circumferential direction of the large-end-portion inner peripheral surface 33.

Specifically, a side of the small-end-portion inner peripheral surface 34 close to the large end portion 12*a* is in strong contact with the pin 21 of the oscillating arm 14, and a side of the large-end-portion inner peripheral surface 33 close to the small end portion 12*b* is in strong contact with the drive cam 112. The large-end-portion inner peripheral surface 33 and the drive cam 112 are not in uniform contact with each other in the circumferential direction of the large-end-portion inner peripheral surface 33. Since a load in the same direction acts on each end of the oscillating arm 14, a moment Mx1 generated in the oscillating arm 14 does not act as a moment that tilts the oscillating arm 14, as shown in FIG. 8B.

In contrast, in the variable valve system in which the pin 21 and the pin 22 are provided on the same side of the control shaft 13, as shown in FIGS. 9A and 9B, loads act as follows when the valve is opened. That is, when the drive shaft 11 rotates and the cam body 112*a* moves down, the pin 21 is also moved down via the link arm 12. Then, the pin 22 is also moved down via the oscillating arm 14.

Subsequently, the oscillating cam 16 is pushed down via the link rod 15, so that the valve is opened. When the valve is thus opened, a load in the pulling direction acts on the link arm 12, as shown in FIG. 9A, and a downward load acts on one end of the oscillating arm 14 in the control-shaft axial direction, as shown in FIG. 9B, but an upward load acts on the other end of the oscillating arm 14 in the control-shaft axial direction. Therefore, a contact load occurs on the upper side of the small end portion 12*b* and a contact load occurs on the lower side of the large end portion 12*a*, as schematically shown by diagonal lines in FIG. 9C. For this reason, the small-end-portion inner peripheral surface 34 and the pin 21 of the oscillating arm 14 are not in uniform contact with each other in the circumferential direction of the small-end-portion inner peripheral surface 34. The large-end-portion inner peripheral surface 33 and the drive cam 112 are not in uniform contact with each other in the circumferential direction of the large-end-portion inner peripheral surface 33. More specifically, a clearance is easily formed on the side of the small-end-portion inner peripheral surface 34 close to the large end portion 12*a*, and a clearance is easily formed on the side of the large-end-portion inner peripheral surface 33 close to the small end portion 12*b*. Since loads in opposite directions respectively act on both ends of the oscillating arm 14 in the control-shaft axial direction, a large moment Mx2 for tilting the oscillating arm 14 occurs, as shown in FIG. 9B.

In the variable valve system in which the pin 21 and the pin 22 are provided on the same side of the control shaft 13, the moment that tilts the oscillating arm 14 can be reduced by minimizing the distance between the loads and reducing the length of the moment arm. In other words, the moment that tilts the oscillating arm 14 can be reduced by reducing the distance between the pin 21 and the pin 22, that is, the distance between the link arm 12 and the link rod 15.

In the variable valve system 10 of this embodiment having the above-described configuration, the contact area 53 (third sliding contact area 53) between the eccentric cam 132 of the control shaft 13 and the oscillating arm 14 is lubricated with lubricant from the main lubricant flow path 31.

Figure 10A:
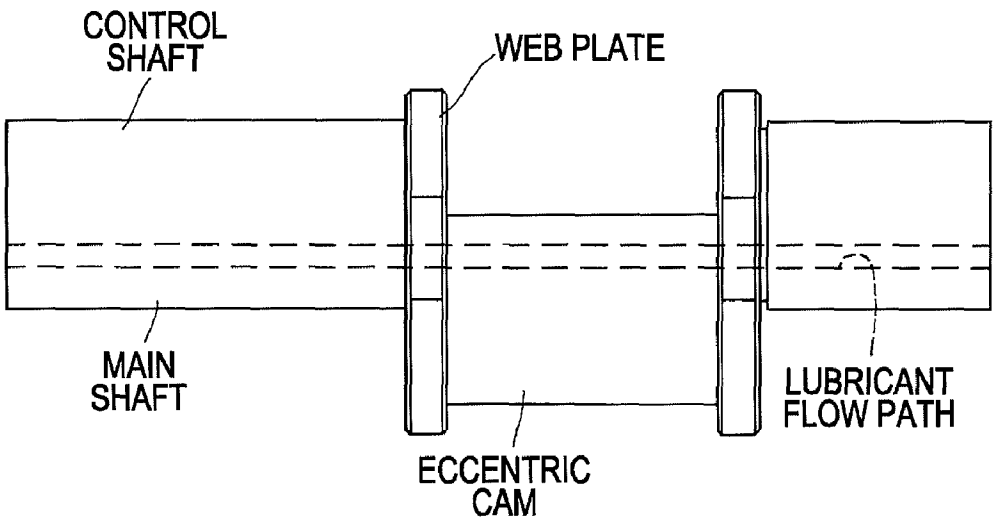
FIG. 10A is a front view schematically showing a crank-shaped control shaft having a lubricant flow path therein.
Figure 10B:
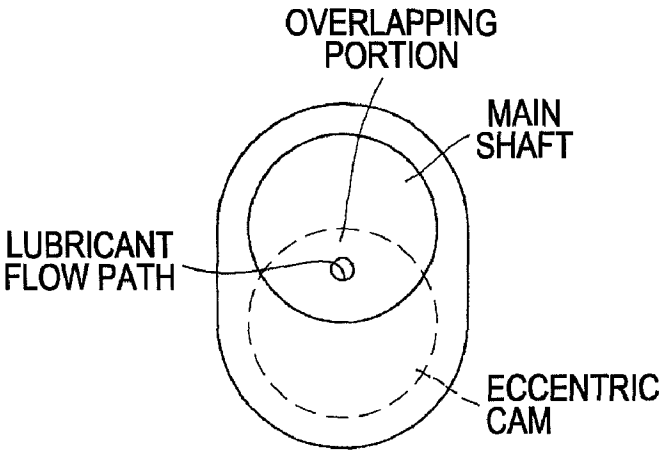
FIG. 10B is a side view schematically showing the crank-shaped control shaft.

When a lubricant flow path is provided in a crank-shaped control shaft, as shown in FIGS. 10A and 10B, it also exists in a connecting portion (overlapping portion) between a main shaft and an eccentric cam on a cross section of the connecting portion perpendicular to the control shaft (see FIGS. 10B). Therefore, the strength becomes considerably lower than in the case in which the lubricant flow path is not provided in the connecting portion. Hence, it is necessary to increase the diameter of the main shaft or the eccentric cam so that the total cross-sectional area of the connecting portion increases.

In contrast, in this embodiment, lubricant can be supplied to the contact area between the eccentric cam 132 of the control shaft 13 and the oscillating arm 14 without forming a lubricant flow path in the crank-shaped control shaft 13. Therefore, the strength of the connecting portion between the main shaft 131 and the eccentric cam 132 can be maintained. For this reason, lubricant can be supplied to the contact area between the eccentric cam 132 of the control shaft 13 and the pin 21 of the oscillating arm 14 without increasing the weight of the control shaft 13 to achieve a sufficient strength.

Since there is no need to form a lubricant flow path in the crank-shaped control shaft 13 in this embodiment, an overlapping area between the main shaft 131 and the eccentric cam 132, as viewed in the axial direction of the control shaft 13, can be made smaller than the case in which the lubricant flow path is formed in the crank-shaped control shaft 13. That is, it is possible to increase the space between the axis of the main shaft 131 and the axis of the eccentric cam 132, to increase the degree of flexibility in design of the control shaft 13, and to increase the moving range of the valve.

Since the pin 21 and the pin 22 are provided on the same side of the control shaft 13 in the variable valve system 10 of the embodiment, the oscillating arm 14 is pulled down by the drive cam 112 so as to lift the valve. Since a load in the pulling direction acts on the link arm 12, a clearance can be relatively easily formed in portions where the first end and the second end of the second lubricant flow path 35 are open. In other words, lubricant easily flows into the second lubricant flow path 35 from the first end, and easily flows out the second end. Hence, in this embodiment, it is possible to improve the lubrication performance of the second sliding contact area 52 between the pin 21 of the oscillating arm 14 and the small end portion 12*b* of the link arm 12.

In the variable valve system 10 in which the valve is lifted by pulling down the oscillating arm 14 by the driving cam 112, a large tilting moment Mx2 (see FIG. 9B) acts on the oscillating arm 14 because of the characteristic load direction. Therefore, the eccentric cam 132 of the control shaft 13 and the control-shaft support portion 143 of the oscillating arm 14 are not in uniform contact with each other. In other words, an upper half of the control-shaft support portion 143 of the oscillating arm 14 strongly contacts the eccentric cam 132 of the control shaft 13 on the side close to the link arm 12, and a lower half thereof strongly contacts the eccentric cam 132 of the control shaft 13 on the side close to the link rod 15. That is, on the side of the control-shaft support portion 143 close to the link arm 12, the upper half of the oscillating arm 14 strongly contacts the eccentric cam 132, but a clearance occurs relatively easily in the lower half. The lubricant enters the clearance, and properly lubricates the portion.

Accordingly, in this embodiment, the second end of the third lubricant flow path 39 opens at the position shifted from the center position 60 of the third sliding contact area 53 in the control-shaft axial direction toward the link arm 12 adjacent to the oscillating arm 14 in the control-shaft axial direction, as shown in FIG. 6.

In the variable valve system in which the valve is lifted by pulling down the oscillating arm 14 by the drive cam 112, a large tilting moment acts on the oscillating arm 14 because of the load direction. Therefore, the eccentric cam 132 of the control shaft 13 and the control-shaft support portion 143 of the oscillating arm 14 are not in uniform contact with each other. In other words, the upper half of the control-shaft support portion 143 of the oscillating arm 14 strongly contacts the eccentric cam 132 of the control shaft 13 on the side close to the link arm 12, and the lower half strongly contacts the eccentric cam 132 on the side closer to the link rod 15. This allows the lubricant to easily flow out from the second end of the third lubricant flow path 39. Therefore, it is possible to improve the lubrication performance of the third sliding contact area 53 between the eccentric cam 132 of the control shaft 13 and the control-shaft support portion 143 of the oscillating arm 14.

When the second end of the third lubricant flow path 39 opens at the position shifted from the center position 60 of the third sliding contact area 53 in the control-shaft axial direction toward the link rod 15 in the control-shaft axial direction, it may be blocked by tilting of the oscillating arm 14, and this may reduce supply of the lubricant.

The lubricant can be easily supplied to the side of the third sliding contact area 53 close to the link rod 15 by the first lubricant groove 40 provided in the control-shaft support portion 143. This can improve the lubrication performance of the third sliding contact area 53. Further, by forming the first lubricant groove 40 in the control-shaft support portion 143 of the oscillating arm 14, the lubricant can be easily guided at low cost to the side of the control-shaft support portion 143 of the oscillating arm 14 close to the link rod 15, where the eccentric cam 132 of the control shaft 13 contacts strongly.

In the variable valve system 10 in which the valve is lifted by pulling down the oscillating arm 14 by the drive cam 112, as in this embodiment, the load acting on the link rod 15 is lower than the load acting on the link arm 12. That is, the force of contact with the side close to the link rod 15 is relatively weaker than the force of contact with the side close to the link arm 12. Therefore, in this embodiment, the contacting area of the arm-body-side control-shaft support portion 37 tends to be slightly decreased by the first lubricant groove 40, but lubrication and cooling performance can be greatly improved by guiding a sufficient amount of lubricant to the third sliding contact area 53.

Figure 11:
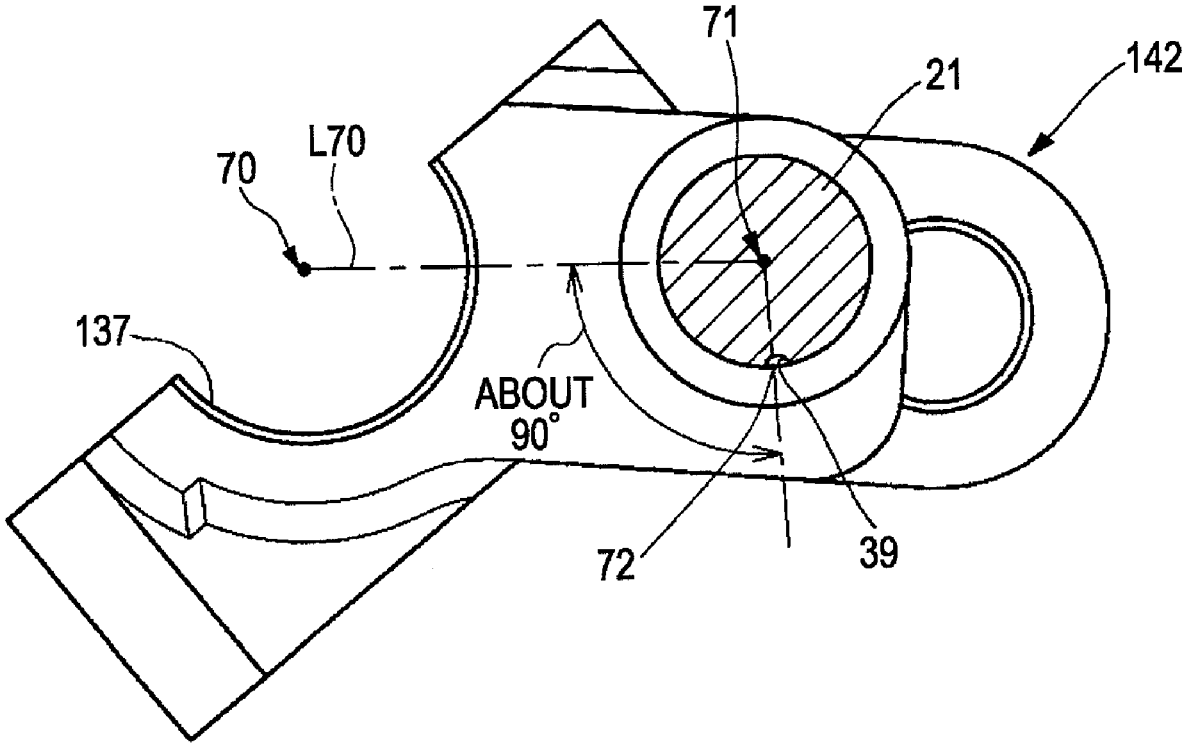
FIG. 11 is an explanatory view schematically showing the arm body of the oscillating arm from the variable valve system of the embodiment.

In the above-described embodiment, the first end 72 of the third lubricant flow path 39, which is open in the outer peripheral surface of the pin 21 of the oscillating arm 14, is closer to the drive shaft 11 than a straight line L70, as shown in FIG. 11. The straight line L70 connects the oscillation center 70 of the oscillating arm 14 or the center 70 of the control-shaft support portion 143, to the center 71 of the pin 21 of the oscillating arm 14 serving as the center (cross section) of the connecting portion between the oscillating arm 14 and the link arm 12, when viewed in the control-shaft axial direction. That is, the first end 72 of the third lubricant flow path 39, which opens into the second sliding contact area 52, is provided on the side of the straight line L70 close to the drive shaft 11, when viewed in the control-shaft axial direction.

In the variable valve system in which the valve is lifted by pulling down the oscillating arm 14 by the drive cam 112, a load in the pulling direction acts on the link arm 12. That is, in the portion where the first end 72 of the third lubricant flow path 39 opens, a clearance occurs relatively easily. Since this allows the lubricant to flow into the first end 72 of the third lubricant flow path 39, the lubricant from the third lubricant flow path 39 can improve the lubrication performance of the third sliding contact area 53 between the eccentric cam 132 of the control shaft 13 and the control-shaft support portion 143 of the oscillating cam 14.

In particular, it is preferable to set the position of the first end 72 of the third lubricant flow path 39 so that a straight line connecting the oscillation center 70 of the oscillating arm 14 or the center 70 of the control-shaft support portion 143 to the center 71 of the pin 21 of the oscillating arm 14 be substantially orthogonal to a straight line connecting the center of the first end 72 of the third lubricant flow path 39 to the center 71 of the pin 21 of the oscillating arm 14. In this case, since the lubricant easily flows into the first end 72 of the third lubricant flow path 39, the lubricant from the third lubricant flow path 39 can improve the lubrication performance of the third sliding contact area 53 between the eccentric cam 132 of the control shaft 13 and the control-shaft support portion 143 of the oscillating arm 14. The reasons for this are as follows:

First, in the variable valve system 10, the first end 72 of the third lubricant flow path 39 communicates with the second lubricant flow path 35 in the link arm 12 at least twice in every one rotation of the drive shaft 11 at any operating angle and that this allows reliable lubrication of the third sliding contact area 53. This positional relationship can apply not only to the link geometry adopted in this embodiment, but also to other various geometries.

Second, since the valve is lifted by pulling down the oscillating arm 14 by the drive cam 112 in the variable valve system 10, the first end 72 of the third lubricant flow path 39 and the small-end-portion inner peripheral surface 34 of the link arm 12 are prevented from being brought into strong contact by setting the position of the first end 72 of the third lubricant flow path 39 in this way.

That is, a clearance easily occurs on the side of the small-end-portion inner peripheral surface 34 close to the large end portion 12*a* in the variable valve system 10 of this embodiment, as described above. Therefore, when the first end 72 of the third lubricant flow path 39 opens in this portion, the contacting area between the small-end-portion inner peripheral surface 34 and the pin 21 does not decrease and the PV value (i.e., a value representing the product of the pressure and a sliding velocity) does not increase due to the presence of the open first end 72 of the third lubricant flow path 39. Moreover, since an appropriate clearance exists in this portion, the lubrication performance of the portion is further improved, compared with the link method of the comparative example (see FIGS. 8A, 9A). In addition, since the lubricant easily flows into the first end 72 of the third lubricant flow path 39, the lubrication performance of the third sliding contact area 53 can be improved by the lubricant from the third lubricant flow path 39.

Figure 12:
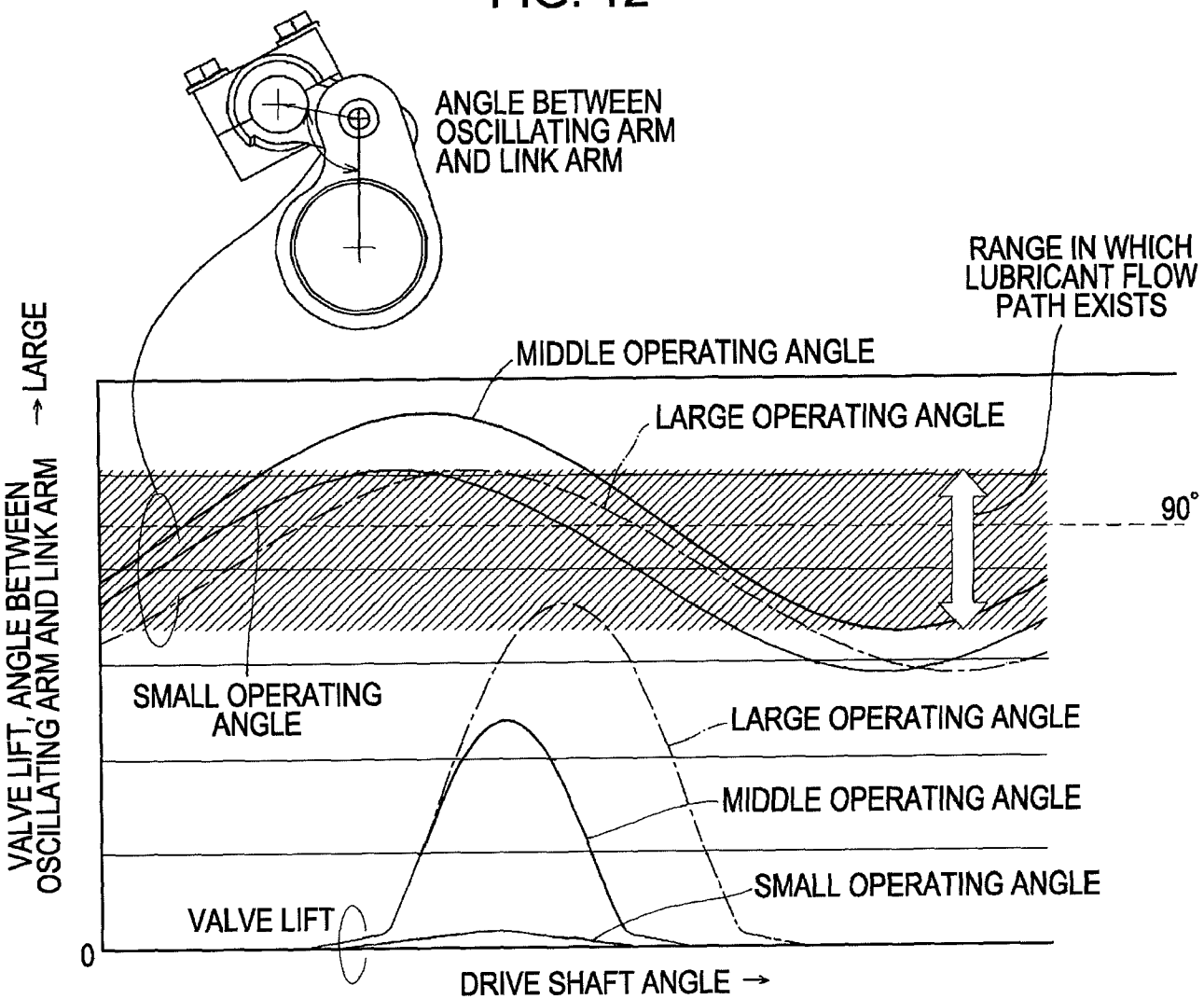
FIG. 12 is an explanatory view and graph showing valve lifts and angles between the oscillating arm and the link arm at small to large operating angles with respect to the angle of a drive shaft.

FIG. 12 shows the valve lifts and the angles between the oscillating arm 14 and the link arm 12 at the small, middle, and large operating angles with respect to the drive-shaft angle. When being set in the range diagonally shaded in FIG. 11, the first end 72 of the third lubricant flow path 39 can communicate lubricant to the second end of the second lubricant flow path 35, which is open in the small-end-portion inner peripheral surface 34 of the link arm 12, at least twice in every one rotation of the drive shaft 11 at any of the small, middle, and large operating angles.

Thus, the lubrication performance of the third sliding contact area 53 between the eccentric cam 132 of the control shaft 13 and the control-shaft support portion 143 of the oscillating arm 14 can be improved by the lubricant introduced from the first end 72 of the third lubricant flow path 39.

Figure 13:
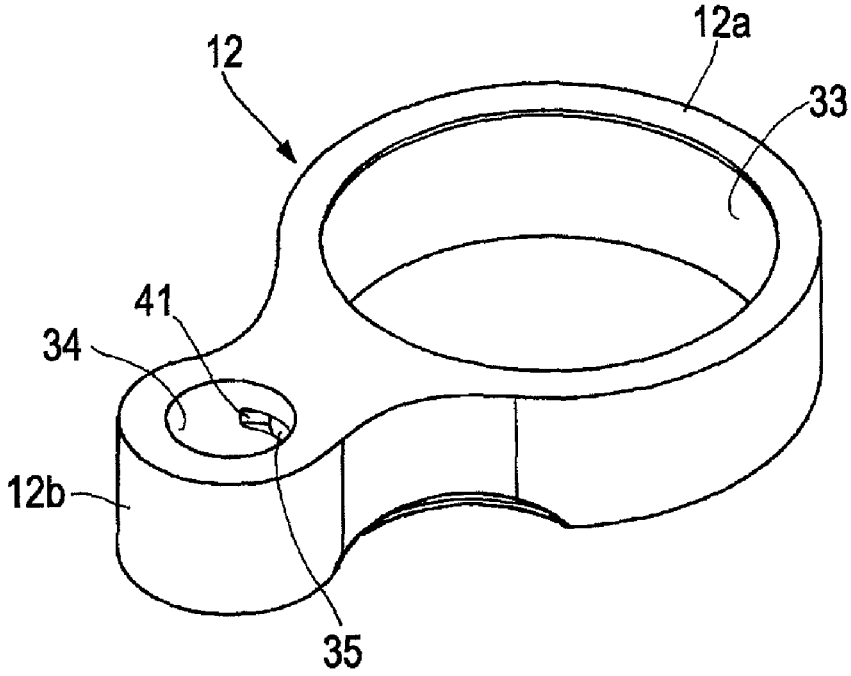
FIG. 13 is an perspective view showing a modification of a link arm.
Figure 14:
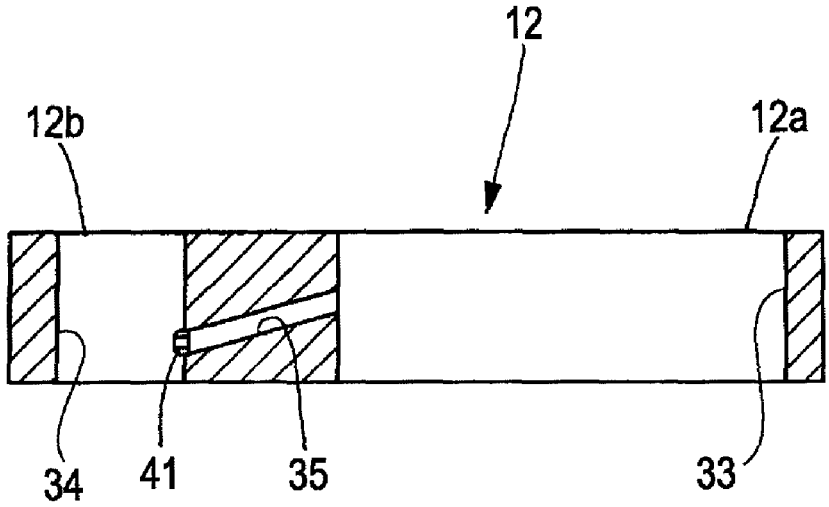
FIG. 14 is an cross-sectional view showing the modification of the link arm.

As shown in FIGS. 13 and 14, a second lubricant groove 41 may be provided at a position in the small end portion 12*b* of the link arm 12 on a side of the second sliding contact area 52 between the pin 21 of the oscillating arm 14 and the small end portion 12*b* of the link arm 12 close to the large end portion 12*a* in the above-described variable valve system 10. The second lubricant groove 41 is connected to the second end of the second lubricant flow path 35, and extends in the circumferential direction of the second sliding contact area 52. That is, the second lubricant groove 41 connected to the second end of the second lubricant flow path 35 and extending along the small-end-portion inner peripheral surface 34 of the link arm 12 may be provided in the side of the small-end-portion inner peripheral surface 34 close to the large end portion 12*a*. This can further improve the lubrication performance of the second sliding contact area 52.

By forming this second lubricant groove 41 in the small-end-portion inner peripheral surface 34, the lubrication performance of the second sliding contact area 52 between the pin 21 of the oscillating arm 14 and the small end portion 12*b* of the link arm 12 can be improved further. This advantage can be obtained by utilizing the characteristic of the variable valve system 10 in that the valve is lifted by pulling down the oscillating arm 14 by the drive cam 112, and that a contact load does not occur in this portion, that is, a clearance occurs relatively easily on the side of the small-end-portion inner peripheral surface 34 close to the large end portion 12*a*.

While the invention has been disclosed with reference to certain preferred embodiments, numerous modifications, alterations, and changes to the described embodiments are possible without departing from the sphere and scope of the invention, as defined in the appended claims and equivalents thereof. Accordingly, it is intended that the invention not be limited to the described embodiments, but that it have the full scope defined by the language of the following claims.

What is claimed is:

1. A variable valve system for an internal combustion engine, the system comprising:

a drive shaft configured to rotate in synchronization with rotation of the engine;

a drive cam disposed about an outer periphery of the drive shaft;

a link arm having a first end and a second end, the first end connected to an outer periphery of the drive cam to rotate relative to the drive cam;

a control shaft extending parallel to the drive shaft and including a main shaft and an eccentric cam, wherein an axis of the main shaft is spaced apart from an axis of the eccentric cam;

an oscillating arm having a control shaft support portion rotatably connected to the eccentric cam of the control shaft, and having a pin connected to the second end of the link arm, the oscillating arm being configured and arranged to be oscillated by the link arm;

a link rod having a first end and a second end, the first end rotatably connected to the oscillating arm;

an oscillating cam rotatably supported by the drive shaft and connected to the second end of link rod, the oscillating cam being configured and arranged to actuate a valve of the engine;

a main lubricant flow path provided in the drive shaft;

a first lubricant flow path formed in the drive shaft and the drive cam, the first lubricant path being configured to cause the main lubricant flow path to communicate lubricant to a first sliding contact area between the drive cam and the first end of the link arm;

a second lubricant flow path formed in the link arm and configured to cause the first sliding contact area to communicate lubricant to a second sliding contact area between the pin of the oscillating arm and the second end of the link arm; and a third lubricant flow path formed in the oscillating arm and configured to cause the second sliding contact area to communicate lubricant to a third sliding contact area between the eccentric cam of the control shaft and the control shaft support portion of the oscillating arm;

wherein the second lubricant flow path includes a first end open to a side of the first sliding contact area close to the second end of the link arm, and a second end open to a side of the second sliding contact area close to the first end of the link arm.

2. The variable valve system according to claim 1, wherein the oscillating arm is adjacent to the link arm in an axial direction of the control shaft.

3. The variable valve system according to claim 1, wherein the third lubricant flow path includes a first end open to the second sliding contact area and a second end open to the, third sliding contact area; and wherein the second end of the third lubricant flow path is open at a position offset toward the link arm from the center of the third sliding contact area in an axial direction of the control shaft.

4. The variable valve system according to claim 3, wherein the control-shaft support portion of the oscillating arm includes a first lubricant groove crossing the center of the third sliding contact area in the axial direction of the control shaft.

5. The variable valve system according to claim 4, wherein the first lubricant groove extends in the axial direction of the control shaft.

6. The variable valve system according to claim 5, wherein the oscillating arm includes a cap and an arm body, the arm body including the pin; and wherein the control-shaft support portion includes a cap-side control-shaft support portion provided in the cap and an arm-body-side control-shaft support portion provided in the arm body, the first lubricant groove being provided in the arm-body-side control-shaft support portion of the arm body.

7. The variable valve system according to claim 3, wherein the second end of the third lubricant flow path opens to the second sliding contact area at a position closer to the drive shaft than a straight line connecting a center of the control shaft support portion and a center of the pin of the oscillating arm, when viewed in the axial direction of the control shaft.

8. The variable valve system according to claim 3, wherein the first end of the third lubricant flow path opens to the third sliding contact area at a position configured and arranged to communicate with the second end of the second lubricant flow path at least twice per single rotation of the drive shaft, regardless of a position of the eccentric shaft.

9. The variable valve system according to claim 3, wherein the first end of the third lubricant flow path is positioned so that a straight line connecting the center of the control-shaft support portion and the center of the pin is substantially orthogonal to a straight line connecting the center of the first end of the third lubricant flow path and the center of the pin, when viewed in the axial direction of the control shaft.

10. The variable valve system according to claim 3, wherein a lubricant groove is formed in the second end of the link arm, the lubricant groove communicating with the second end of the second lubricant flow path and extends in a circumferential direction of the second sliding contact area.

11. A method for lubricating a variable valve system for an internal combustion engine, the variable valve system including a drive shaft configured to rotate in synchronization with rotation of the engine, a drive cam disposed about an outer periphery of the drive shaft, a link arm having a first end connected to an outer periphery of the drive cam to rotate relative to the drive cam, a control shaft extending parallel to the drive shaft and including a main shaft and an eccentric cam, wherein an axis of the main shaft is spaced apart from an axis of the eccentric cam, an oscillating arm. having a control shaft support portion rotatably connected to the eccentric cam of the control shaft, the oscillating arm having a pin connected to a second end of the link arm, the oscillating arm being configured and arranged to be oscillated by the link arm to transfer a drive force of the drive cam, a link rod having a first end rotatably connected to the oscillating arm, an oscillating cam rotatably supported by the drive shaft and connected to a second end of link rod, the oscillating cam being configured and arranged to actuate a valve of the engine, the method comprising:

flowing lubricant through a main lubricant flow path in the drive shaft;

flow lubricant through a first lubricant flow path in the drive shaft and the drive cam, thereby causing the main lubricant flow path to communicate lubricant to a first sliding contact area between the drive cam and the first end of the link arm;

flowing lubricant through a second lubricant flow path in the link arm, thereby causing the first sliding contact area to communicate lubricant to a second sliding contact area between the pin of the oscillating arm and the second end of the link arm; and flowing lubricant through a third lubricant flow path in the oscillating arm, thereby causing the second sliding contact area to communicate lubricant to a third sliding contact area between the eccentric cam of the control shaft and the control shaft support portion of the oscillating arm;

wherein the second lubricant flow path includes a first end open to a side of the first sliding contact area close to the second end of the link arm, and a second end open to a side of the second sliding contact area close to the first end of the link arm.

12. A variable valve system for an internal combustion engine, the system comprising:

a drive shaft configured to rotate in synchronization with rotation of the engine;

a drive cam disposed about an outer periphery of the drive shaft;

a link arm having a first end and a second end, the first end connected to an outer periphery of the drive cam to rotate relative to the drive cam;

a control shaft extending parallel to the drive shaft and including a main shaft and an eccentric cam, wherein an axis of the main shaft is spaced apart from an axis of the eccentric cam;

an oscillating arm having a control shaft support portion rotatably connected to the eccentric cam of the control shaft, and having a pin connected to the second end of the link arm, the oscillating arm being configured and arranged to be oscillated by the link arm;

a link rod having a first end and a second end, the first end rotatably connected to the oscillating arm;

an oscillating cam rotatably supported by the drive shaft and connected to the second end of link rod, the oscillating cam being configured and arranged to actuate a valve of the engine;

a main lubricant flow path provided in the drive shaft;

means for communicating lubricant from the main lubricant flow path to a first sliding contact area between the drive cam and the first end of the link arm;

means for communicating lubricant from the first sliding contact area to a second sliding contact area between the pin of the oscillating arm and the second end of the link arm; and means for communicating lubricant from the second sliding contact area to a third sliding, contact area between the eccentric cam of the control shaft and the control shaft support portion of the oscillating arm;

wherein the means for communicating lubricant from the second sliding contact area to the third sliding contact area includes a first end open to a side of the first sliding contact area close to the second end of the link arm, and a second end open to a side of the second sliding contact area close to the first end of the link arm.

* * * * *